US005344105A

United States Patent [19]

Youhanaie

[11] Patent Number: 5,344,105

[45] Date of Patent: Sep. 6, 1994

[54] RELATIVE GUIDANCE USING THE GLOBAL POSITIONING SYSTEM

[75] Inventor: Mark Youhanaie, West Hills, Calif.

[73] Assignee: Hughes Aircraft Company, Los Angeles, Calif.

[21] Appl. No.: 947,623

[22] Filed: Sep. 21, 1992

[51] Int. Cl.[5] ..... F41G 7/28

[52] U.S. Cl. ..... 244/3.14; 342/62

[58] Field of Search ..... 342/62, 352, 357, 453, 342/463; 244/3.14, 3.19, 3.11; 89/41.03

[56] References Cited

U.S. PATENT DOCUMENTS

| | | | |
|---|---|---|---|
| 4,741,245 | 5/1988 | Malone | 342/357 |
| 4,949,089 | 8/1990 | Ruszkowski et al. | 342/357 |
| 5,131,602 | 7/1992 | Linick | 244/3.14 |

*Primary Examiner*—Ian J. Lobo

*Attorney, Agent, or Firm*—Randall M. Heald; Charles D. Brown; Wanda K. Denson-Low

[57] ABSTRACT

A method for guiding a vehicle (30) to a target (28) includes furnishing a first vehicle (20) having a first global positioning system (GPS) receiver (24) fixed to receive global positioning signals from a selected constellation (46) of satellites in orbit above the earth and the second vehicle (30) having a second GPS receiver (32) fixed to receive global positioning signals from the same selected constellation (46) of GPS satellites. The first vehicle (20) locates the target (28) with an onboard sensor (26) and converts the location of the target (28) to the frame of reference of the selected constellation (46) of satellites of the GPS. The first vehicle (20) communicates this target position and the available set of GPS satellites to a navigation system of the second vehicle (30). The second vehicle (30) proceeds to the target location provided from the first vehicle (20 ) in the frame of reference of the GPS under control of its navigation system using the positioning signal derived from the second GPS receiver (32) fixed to receive positioning signals from the selected constellation (46) of satellites. In these operations, the second vehicle (30) remains within a sufficiently small operating distance of the position of the first vehicle (20) that variations in systematic bias errors between the first GPS receiver (24) and the second GPS receiver (32) are negligible.

15 Claims, 2 Drawing Sheets

RELATIVE GUIDANCE USING THE GLOBAL POSITIONING SYSTEM

BACKGROUND OF THE INVENTION

This invention relates to the remote guidance of vehicles, and, more particularly, to a method for guiding a vehicle using two global positioning satellite system receivers to provide relative guidance and reduce positioning errors.

There are several basic techniques for guiding vehicles, typically flight vehicles, to their targets or destinations. In the most common, the vehicle itself has an onboard sensor that makes sensor contact with ("acquires") the target. A vehicle controller then steers the vehicle to the acquired target. This approach works well in many contexts, where the on-board sensor can actually make initial contact with the target and can provide sufficient information for guidance.

The on-board sensor approach becomes less satisfactory where attempts are made to avoid acquisition of the target, as by hiding it. In that case, more information may be needed than can be provided by the on-board sensor, leading to tile use in the guidance of information from other sources. The approach of relying on on-board sensors may also not work close to the ground when the sensor field is cluttered, or where tile data provided by the sensor is not sufficiently precise.

Technical attributes of the sensor must also be viewed in relation to its cost. In the case of precision guided munitions, guided by light, infrared, or radar sensors, the cost of the sensor and its electronics is a significant fraction of the cost of the vehicle. The more precise the sensor, the higher its cost.

With these technical considerations and the system costs in mind, techniques for guiding vehicles to their destinations or targets using information from remotely positioned controllers or sensors have been developed. In a civilian context, an all-weather aircraft landing system may use, in part, remotely generated navigational information to guide an aircraft to a safe landing even in a near total absence of visibility. In a military context, precision guided weapons can be guided to their targets by using a sensor on a targeting aircraft to locate a target, and providing the location of the target to a weapon launched by the aircraft. Increasingly sophisticated data links have made it possible to use a variety of remotely generated information in guiding precision munitions and missiles to their targets. These techniques reduce (or eliminate) the sensor costs of the weapons themselves, thereby significantly reducing the disposable cost of the weapon system.

One guidance approach that has been suggested for both civilian and military remotely guided vehicles utilizes the global positioning system (GPS). The GPS provides a number of satellites in orbit above the earth, each satellite emitting one or two navigational signals. The GPS satellites are arranged so that there will always be several satellites in the field of view of any pertinent place on the earth. The precise location of that point can be fixed by measuring the time required for the navigational signal of three, or preferably four, of the satellites to reach that point, in a variant of a triangulation approach. The GPS system is largely unaffected by weather, and, in the military context, is not affected by many camouflage techniques.

The GPS system is in operation, and low-precision GPS receivers are available for as little as about a thousand dollars for use by individuals. Higher precision GPS receivers are used in civilian and military applications. Depending upon the precision of the GPS receiver chosen, the GPS system allows the determination of absolute position to within a certainty of about 30 feet at most locations on the earth. This degree of certainty means that there is a specified high probability that the Indicated location is within 30 feet of the correct location, and is known as the circular error probability (CEP).

GPS-based guidance systems have been proposed for use in aircraft landing systems and guided munitions. Unfortunately, in both of these applications the Indicated 30 foot CEP is too great to be practical in most instances. A 30 foot error in the altitude of the runway in an aircraft landing system can lead to disaster. A miss of 30 feet by many precision guided munitions can result in failure of the mission to achieve its objectives.

This problem has been to some extent solved for landing systems and other civilian applications by analyzing the nature of the inherent GPS error. The greatest part of the error arises from bias-type, systematic errors. Examples of error sources are slight uncertainties in knowing the precise positioning of the satellites, slight errors in the satellite clock, and signal variations caused by atmospheric conditions. These errors identically affect all GPS receivers within an area. They can be accounted for by locating a fixed GPS receiver at a surveyed place whose true location is known precisely (e.g., the end of the runway), measuring the range of that fixed receiver to the satellites in view in GPS coordinates, and comparing the measured ranges with the true ranges determined from the known location to obtain correction values for each satellite. These correction values are broadcast to mobile GPS systems in the area, which then track the satellites that yield the best positional information. The ranges determined by the mobile systems in GPS coordinates are corrected by the correction values broadcast by the fixed receiver. With this "differential GPS" technique, the absolute position error using GPS can be reduced to less than 10 feet CEP.

The differential GPS approach would be operationally unsuited for many military targeting applications, many other military applications, and many civilian applications. In these cases, a GPS receiver cannot be placed at an accurately surveyed location whose true position is known, to provide a measurement of the bias-type error corrections.

There is therefore a need for an improved technique for providing remote navigational and guidance information for use in both civilian and military applications. The present invention fulfills this need, and further provides related advantages.

SUMMARY OF THE INVENTION

The present invention furnishes a relative GPS guidance technique that provides highly precise positioning information using the GPS. The technique negates bias-type GPS errors, but does not require the placement of a GPS receiver at a place whose location is known precisely by surveying. The approach of the invention permits the guided vehicle to be guided to its target or destination with an accuracy of less than about 5 feet CEP, without any onboard sensor. Only a relatively inexpensive GPS receiver on the guided vehicle and another on a targeting vehicle are required. When the invention is used in a military targeting application, it requires only a single locating of the target by targeting sensor. It does not require continuous illumination of the target by the targeting aircraft, which would permit the targeting aircraft to be tracked.

In accordance with the invention, a method for guiding a guided vehicle to a target comprises the steps of furnishing a first global positioning system (GPS) receiver fixed to receive global positioning signals from a selected constellation of satellites in orbit above the earth, and furnishing a guided vehicle having a guided vehicle GPS receiver fixed to receive global positioning signals from satellites selected from the same constellation. A target is located and its position converted to the frame of reference of the selected constellation of satellites of the GPS based on the position measurements of the first GPS receiver. This position of the target, expressed in the frame of reference of the selected constellation of satellites of the GPS, is communicated to a navigation system of the guided vehicle. The guided vehicle proceeds to this target location under control of its navigation system while using the positioning signal derived from its own guided vehicle GPS receiver fixed to receive positioning signals from the selected constellation of satellites.

There are several keys to the present invention. First, there is no need to determine an absolute location of the target. Only the location relative to some common frame of reference, here chosen as the frame of reference of the GPS signals as received by the first GPS receiver, is required. The system is therefore freed from the need to place a GPS receiver at a known, surveyed location to attain precision information. The location of the target is determined from a targeting location, such as a targeting vehicle, relative to the GPS frame of reference within the circular error probability of the GPS. The location of the target may be determined in any convenient manner, such as radar or laser sighting.

Second, two GPS receivers are used, one at the location of the targeting vehicle and one at the guided vehicle. The two receivers are employed to negate bias-type errors in the GPS receiver on the guided vehicle. Third, the bias error for the two GPS receivers will be nearly the same, where they are constrained to operate using the signals selected from the same group of GPS satellites (a "constellation"). That is, the GPS receiver of the guided vehicle is not allowed to switch freely among different constellations of GPS satellites, as it might do otherwise. Instead, it is constrained to determine its position only from satellites of the constellation employed by the GPS receiver in the targeting vehicle. Fourth, the bias-type error will be most readily negated if the receivers are located sufficiently closely together, and studies have shown that distances of less than about 100 miles will permit nearly total negation of the bias-type errors between the two GPS receivers.

The present invention therefore provides a convenient method of providing guidance to a guided vehicle to reach a target or destination. The guided vehicle requires no sensor, and instead has only a relatively inexpensive GPS receiver. Placement accuracy is excellent, due to the negation of bias-type errors in the GPS signals. Other features and advantages will be apparent from the following more detailed description of the invention, taken in conjunction with the accompanying drawings, which illustrate, by way of example, the principles of the invention.

DETAILED DESCRIPTION OF THE INVENTION

Figure 1:
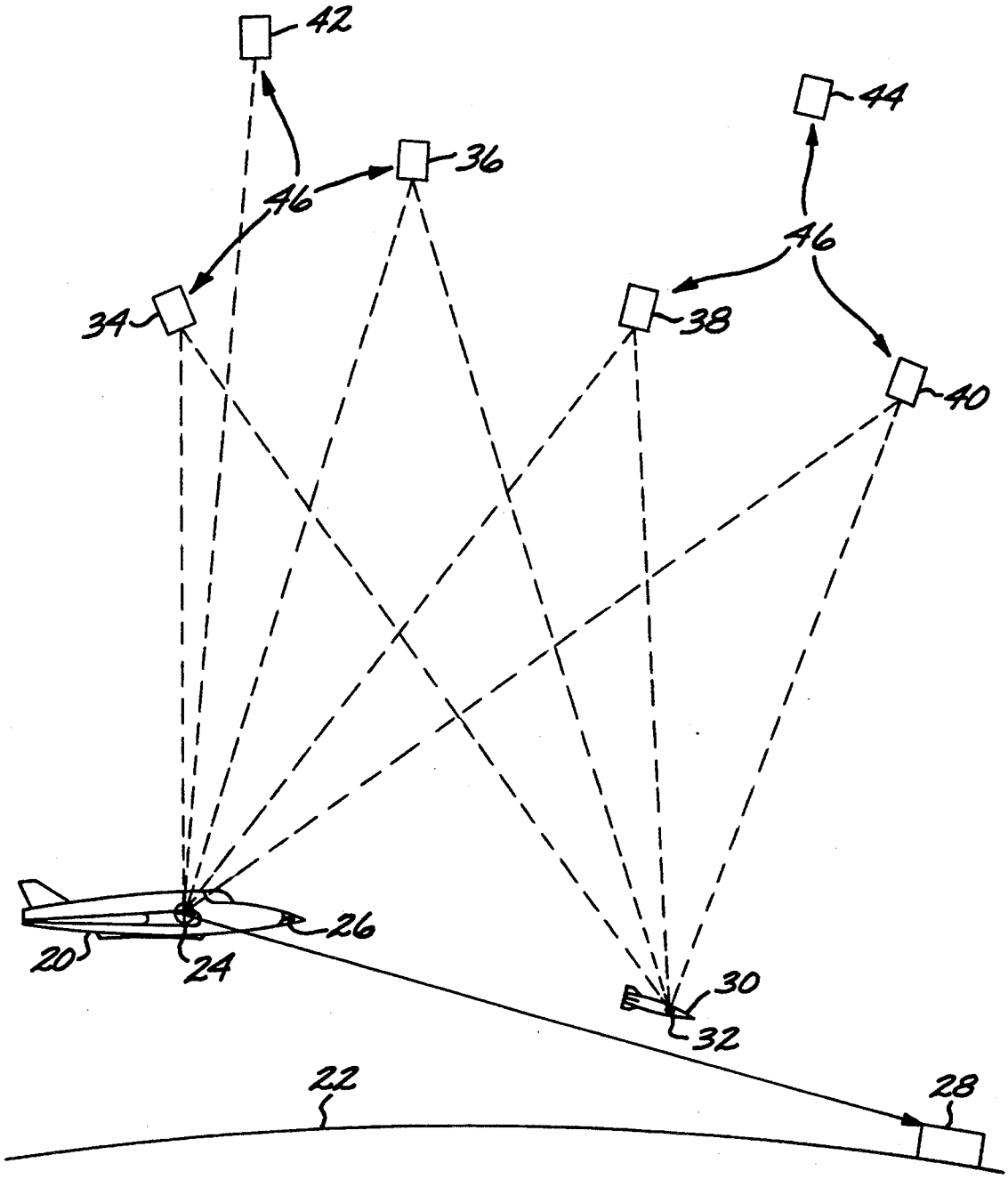
FIG. 1 is a schematic view of a launch/targeting vehicle, guided vehicle, target.

FIG. 1 illustrates a first vehicle, in this case an aircraft 20, flying above the surface of the earth 22. The aircraft 20 is the targeting or control aircraft. The aircraft 20 carries a first global positioning system (GPS) receiver 24 and a sensor 26 capable of sensing a target 28, which in this case is (but need not be) located on the earth 22. The preferred sensor 26 is a radar, most preferably a selective aperture radar (SAR).

A second vehicle, in this case a missile 30, also flies above the surface of the earth 22. The missile 30 carries a second GPS receiver 32, but no sensor related to the present invention. (The missile may, but need not, have a terminal guidance sensor or the like unrelated to the present invention.) The missile 90 is tile guided vehicle in this preferred embodiment. (Equivalently, the sensors could be in surface ships, submarines, torpedoes, land vehicles, etc.)

In orbit above the earth are a number of satellites 34, 36, 38, 40, 42, 44 of the GPS. Five of these satellites, selected as satellites 34, 36, 38, 40, and 42, are identified collectively as a "constellation" 46 herein. The term "constellation" is used to refer to all of the satellites which can be referenced by both the first GPS receiver and the second GPS receiver during a relevant period of time. In this example, the five satellites 34, 36, 38, 40, and 42 are available to be referenced by both GPS receivers 24 and 32. In the illustration, all five satellites are referenced by the receiver 24 in the aircraft. However, in this example at a particular moment in time the signals of only four of the satellites 34, 36, 38, and 40 are selected by the receiver 32 in the missile 30 for referencing. The remaining satellite 42 of the constellation is not referenced at this particular moment for some reason, such as having an overly large bias-type error. At a different time the circumstances may change, and some other group of four satellites from the constellation (e.g., satellites 34, 38, 40, and 42) may be selected for referencing by the receiver 32 in the missile 30. In all of these cases, the satellite 44 is not part of the "constellation" for the GPS receivers 24 and 32, because it is not referenced by the receiver 24 for some reason and made a part of the constellation 46.

In a variation of the present approach, at some other time some smaller number satellites—one, two, or three of the satellites of the constellation 46—may be referenced by the receiver 32 in the missile 30. This use by the receiver 32 of a smaller number of satellites from the constellation 46 is less preferred, because it permits only a partial reduction in the bias-type error. In order to realize the benefits of the invention the receiver 32 is constrained to reference only satellites from the constellation 46 for positional determinations. If other satellites not in the constellation 46 are referenced in the positional determination, the bias-errors are not eliminated.

According to the present invention, the aircraft 20 measures its position in the GPS frame of reference from the constellation 46 of satellites, using its GPS receiver 24. The operation of the GPS system is known in the art, both as to the satellites and their transmissions, and as to the receiver and its mode of operation. Briefly, each of the satellites transmits a coded pulse at a specific moment in time. The receiver receives the coded pulses. From at least three, and preferably four, coded satellite pulses the receiver can determine the position of the receiver, and thence in this case the aircraft 20, relative to the satellites. The position of the aircraft measured by this approach will have some degree of uncertainty, as determined by noise-like errors and bias-type errors, but the sources, magnitudes, and effects of these errors will be discussed subsequently.

The aircraft 20 also determines the position of the target 28 relative to tile aircraft 20 using its sensor 26. By vectorially combining the GPS position measurement and the target position measurement, the position of the target 28 in the frame of reference of the constellation 46 is found.

The missile 30 measures its position in the GPS frame of reference from the constellation 46 of satellites, using its GPS receiver 32. This measurement may be made at the same time as the measurement of the position of the target 28 by the aircraft 20. This measurement may also be, and preferably is, made at a later time than the measurement of the position of the target 28 by the aircraft 20. As will be discussed in greater detail subsequently, the position of the target 28 relative to the missile 90 is then readily determined from this position measurement of the missile 30. The position so determined is corrected for bias-type errors in the GPS position, negating the errors.

Figure 2:
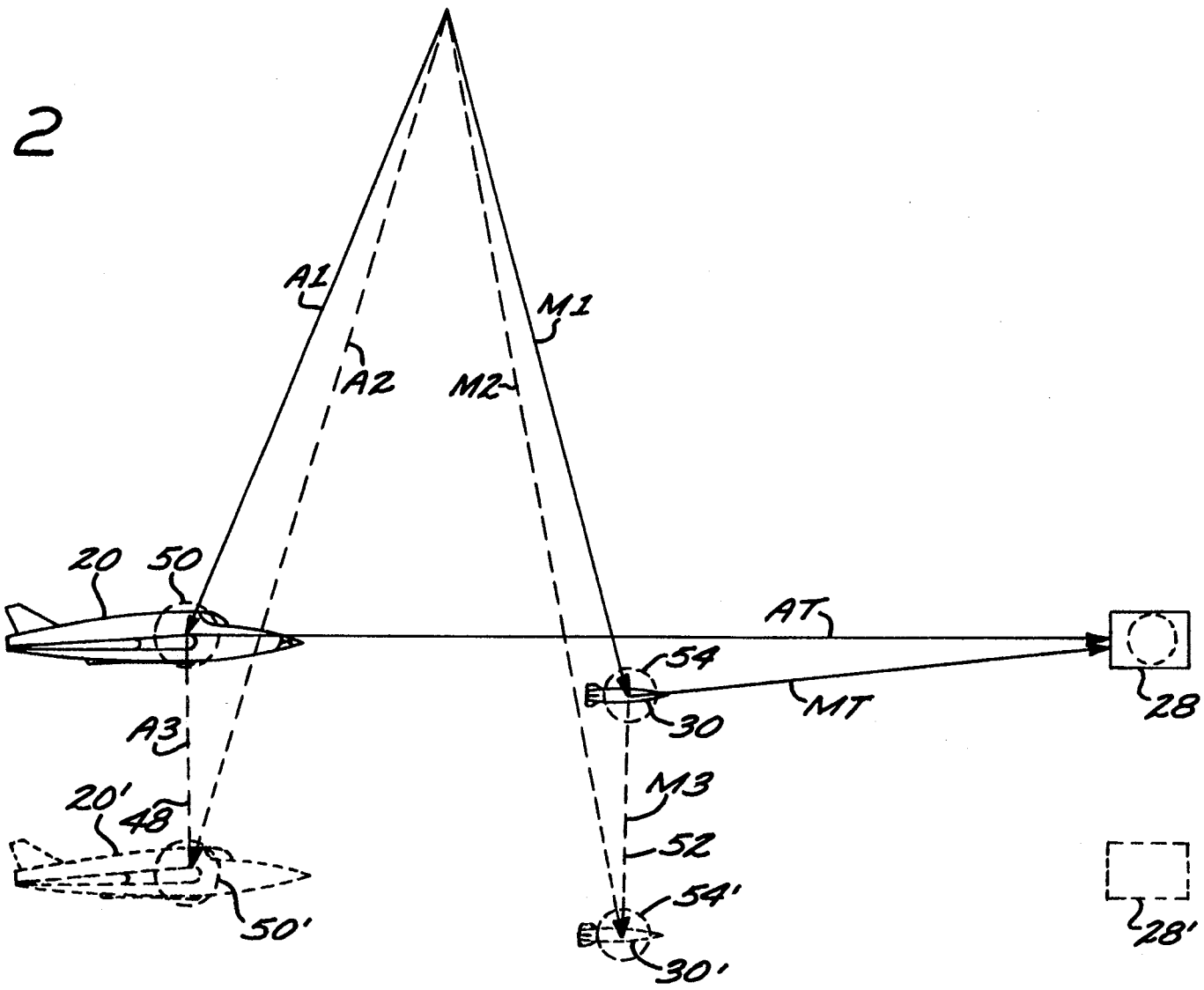
FIG. 2 is a schematic illustration of the negation of the bias-type positioning error.

FIG. 2 is an enlarged version of part of FIG. 1, illustrating the effect of GPS bias-type errors. There are two types of errors that determine the accuracy of position determination using the GPS method. The first is bias-type error. Bias-type error arises from such effects as uncertainty in the position of the orbits of the satellites, time-based discrepancies between the various satellite transmissions, and the effect of the atmosphere on the radio signals of the satellites. According to an analysis of the errors in the GPS measurements, bias-type error constitutes about 80–85 percent of the total uncertainty in position as a result of a measurement. Bias-type error is a systematic error that equally affects the measurements of all receivers in comparable circumstances.

The second type of error is noise-like error. Noise-type error arises from such effects as multipath (arising as a result of reflected signals), quantization (arising as a result of roundoff errors), and receiver electrical noise. Noise-type error constitutes tile remainder of the uncertainty in position measurements, about 15–20 percent of the total. Noise-type error is a random error that affects each GPS receiver differently.

Thus, in a typical situation where the total error is on the order of 90 feet, about 25 feet can be attributed to bias-type errors and about 5 feet can be attributed to noise-type errors. The present approach negates and compensates for the bias-type errors, reducing the total error to on the order of 5 feet.

FIG. 2 provides an analytical tool to understand the operation of the present invention. It should be understood, however, that FIG. 2 does not depict the invention itself.

In FIG. 2, the aircraft 20 and the missile 30 are depicted at their true locations. However, when the aircraft 20 and the missile 30 measure their positions using their GPS receivers, their apparent positions are depicted at 20' and 30'. The apparent position of the aircraft 20' is displaced from the true position of the aircraft 20 by the amount of its bias-type error 48. The bias-type error is not known by the GPS receiver or the aircraft, but can be depicted as a vector because it has an ascertainable magnitude and direction. (In the differential GPS approach discussed previously, the vector is actually determined using the true location of the reference GPS receiver, but not according to the present relative GPS approach.) The position of the aircraft 20 is also displaced from its true position by the amount of the noise-type error, indicated as a sphere 50. The position is indicated as a sphere of uncertainty because the magnitude of the error is not known precisely but a sphere can be drawn which describes a specific probability of containing the actual error. Similarly, the apparent position of the missile 30' is displaced from the true position of the missile 20 by the amount of its bias-type vectorial error 52 and a spherically represented noise-type error 54.

When a position measurement is taken by the aircraft, the aircraft is at a true vectorial location A1 but an apparent vectorial location A2 relative to the GPS constellation 46, the difference being the bias-type error 46, indicated as the vector A3. These vectors, as here defined, satisfy the relation A1+A3=A2. If the position of the target 28 is measured relative to the aircraft at the same time the GPS position of the aircraft is measured, the vector from the aircraft to the target is the vector AT. The position of the target relative to the GPS constellation 46, or, equivalently stated, in the frame of reference of the constellation 46, is A1+AT.

The GPS position analysis for the missile is similar to that of the aircraft. Thus, when a position measurement is taken by the missile, the missile is at a true vectorial location M1 but an apparent vectorial location M2 relative to the GPS constellation 46, the difference being the bias-type error 52, indicated as the vector M3. These vectors, as here defined, satisfy the relation M1+M3=M2. The vector from tile missile 30 to the target at any moment is MT. This is the unknown, but here determined, true path that the missile must follow to reach the target 28. The position of the target relative to the GPS constellation 46, or, equivalently stated, in the frame of reference of the constellation 46, may be stated as M1+MT.

The target 28 is at a fixed location, and therefore $$A1+AT=M1+MT.$$

This relation is applicable as long as the target is fixed, and therefore for such period $$A1(0)+AT(0)=M1(t)+MT(t).$$

'(0)" indicates that the GPS position of the aircraft and the relative target location determined by the sensor on the aircraft are taken simultaneously at some initial time t=0. "(t)" indicates that the GPS position of the missile and the vector from the missile to the target are determined at some later time.

Substituting the relations developed regarding apparent position and bias-type error, and solving for the missile-to-target vector of interest, MT(t), $$MT(t)=[A2(0)-A3(0)]+AT(0)-[M2(t)-M3(t)]$$

If the bias-type errors for the two GPS receivers 24 and 32 are equal, then A3(0) and M3(t) are the same and cancel from the relation. The bias-type errors can be made nearly the same by forcing the GPS receivers 24 and 32 to make their position measurements from the same constellation 46 of GPS satellites, in this case the satellites 34, 36, 38, and 40. That is, and as shown in FIG. 1, other satellites such as 42 and 44 that may be in the field of view during the period from t=0—t are not used by the two receivers 24 and 32. The receivers 24 and 32 are locked to the constellation 46. This locking of the GPS signals to a single constellation is estimated to negate about 75 percent of the bias-type error.

Virtually all of the remainder of the bias-type error can be negated by requiring that the missile operates sufficiently close to the aircraft that changes in atmospheric effects and deviations in line-of-sight angles to the satellites are negligible. While these factors vary with separation between the missile and the air craft, calculations have shown that the total bias-type error can be held to less than about 5 feet if the separation between the missile and the aircraft is less than about 150 miles. Even at distances of 250 miles separation, the bias-type error is less than about 10 feet.

If these conditions are met, so that A3(0) and M3(t) are the same, the preceding equation becomes $$MT(t)=A2(0)+AT(0)-M2(t)$$

This relation is readily interpreted that the vector MT(t) required to guide the missile to the target at any moment in time is determined from the apparent aircraft position as measured by its GPS receiver 24 at some initial time, the relative position of the target to the aircraft as measured by the aircraft sensor 26 at that same initial time, and the apparent missile position as measured by its GPS receiver 92 at the time t (which may be t=0 or some later time).

The important result is that the bias-type errors are eliminated in large part by forcing the GPS receivers 24 and 92 to conduct their measurements from the same constellation 46 of GPS satellites, and further by keeping the missile sufficiently close to the aircraft for the entire mission.

The missile 30 may be launched from the aircraft 20, but need not be launched from the aircraft 20. The targeting aircraft 20 can be another aircraft, such as an aircraft flying at very high altitudes or a controller or AWACS aircraft. The targeting aircraft 20 must operate under the conditions discussed here, however. Nevertheless, the present approach permits the missile to be delivered to near its target by a stealthy aircraft, which need never acquire the target with a sensor and thereby reveal its location. The targeting aircraft need not continuously acquire or illuminate the target—a single relative targeting measurement is sufficient.

For most practical purposes, a stand-off range for the targeting aircraft from the target of 150 miles is sufficient, and permits the missile to be placed to within about 5 feet of the desired target location using only GPS navigational measurements. The missile carries no sensor in this embodiment. In a variation of this approach, the missile may carry a relatively unsophisticated terminal guidance sensor that guides it to the target in the terminal phase of the attack, after being guided to nearly the correct location by the GPS approach discussed here.

Although particular embodiments of the invention have been described in detail for purposes of illustration, various modifications may be made without departing from the spirit and scope of the invention. Accordingly, the invention is not to be limited except as by the appended claims.

What is claimed is:

1. A method for guiding a vehicle to a target, comprising the steps of: furnishing a first vehicle having a first global positioning system receiver aligned to receive global positioning signals from a selected constellation of satellites in orbit above the earth; furnishing a second vehicle having a second global positioning system receiver aligned to receive global positioning signals from the same selected constellation of satellites in orbit above the earth;

the first vehicle locating a target with an onboard sensor and converting the location of the target to the frame of reference of the selected constellation of satellites of the global positioning system;

the first vehicle communicating the position of the target, expressed in the frame of reference of the selected constellation of satellites of the global positioning system, to a navigation system of the second vehicle;

the second vehicle remaining within a sufficiently small operating distance of the position of the first vehicle at the time of the step of locating and converting, that variations in systematic bias errors between the first global positioning system receiver and the second global positioning system receiver are negligible; and the second vehicle proceeding to the target location communicated from the first vehicle under control of its navigation system while using the positioning signal derived from the second global positioning system receiver aligned to receive positioning signals from the selected constellation of satellites.

2. A method for directing a guided vehicle to a target location, comprising the steps of:

furnishing a first global positioning system receiver aligned to receive global positioning signals from a selected constellation of satellites in orbit above the earth;

furnishing a guided vehicle having a second global positioning system receiver aligned to receive global positioning signals from satellites selected from the same constellation of satellites in orbit above the earth;

locating a target and converting the location of the target to the frame of reference of the selected constellation of satellites of the global positioning system based on the position measurements of the first global positioning system receiver;

communicating the position of the target, expressed in the frame of reference of the selected constellation of satellites of the global positioning system, to a navigation system of the guided vehicle;

the guided vehicle remaining within a sufficiently small operating distance of the position of the first global positioning system receiver at the time of the step of locating and converting, that variations in systematic bias errors between the first global positioning system receiver and the second global positioning system receiver are negligible; and the guided vehicle proceeding to the target location provided in the step of communicating under control of its navigation system while using the positioning signal derived from the second global positioning system receiver aligned to receive positioning signals from the selected constellation of satellites.

3. The method of claim 2, wherein the guided vehicle is an aircraft and the target location is a location at which the aircraft is to land.

4. The method of claim 3, wherein the first global positioning receiver is stationary.

5. The method of claim 2, wherein the step of locating a target is accomplished using a sensor.

6. A method for guiding a missile to a target, comprising the steps of:

furnishing a targeting vehicle having a targeting vehicle global positioning system receiver fixed to receive global positioning signals from a selected constellation of satellites in orbit above the earth;

furnishing a missile having a missile global positioning system receiver fixed to receive global positioning signals from the same selected constellation of satellites in orbit above the earth;

the targeting vehicle locating a target with an onboard sensor and converting the location of the target to the frame of reference of the selected constellation of satellites of the global positioning system;

the targeting vehicle communicating the position of the target, expressed in the frame of reference of the selected constellation of satellites of the global positioning system, to a navigation system of the missile; and the missile proceeding to the target location under control of its navigation system using the target position communicated from the targeting vehicle and the positioning signal derived from the missile global positioning system receiver fixed to receive positioning signals from the selected constellation of satellites, wherein the missile remains within a sufficiently small operating distance of the position of the targeting vehicle, at the time of the step of locating and converting, that variations in systematic bias errors between the targeting global positioning system receiver and the missile global positioning system receiver are negligible.

7. The method of claim 6, wherein the targeting vehicle is a guidance control aircraft that does not carry the missile at any time.

8. The method of claim 6, wherein the targeting vehicle is a launch aircraft.

9. The method of claim 6, wherein the selected constellation of global positioning system satellites includes at least four satellites.

10. A method for directing a guided missile to a target location, comprising the steps of:

furnishing a first global positioning system receiver aligned to receive global positioning signals from a selected constellation of satellites in orbit above the earth;

furnishing a guided missile having a second global positioning system receiver aligned to receive global positioning signals from satellites selected from the same constellation of satellites in orbit above the earth;

locating a target and converting the location of the target to the frame of reference of the selected constellation of satellites of the global positioning system based on the position measurements of the first global positioning system receiver;

communicating the position of the target, expressed in the frame of reference of the selected constellation of satellites of the first global positioning system, to a navigation system of the guided missile; and the guided missile proceeding to the target location as communicated by the first global positioning system receiver under control of its guided missile navigation system while using the positioning signal derived from the second global positioning system receiver aligned to receive positioning signals from the selected constellation of satellites.

11. The method of claim 10, wherein the first global positioning system receiver is carried upon a targeting vehicle that does not carry the guided missile at any time.

12. The method of claim 10, wherein the first global positioning system receiver is carried upon a launch vehicle.

13. The method of claim 10, wherein the selected constellation of global positioning system satellites includes four satellites.

14. The method of claim 10, wherein the guided missile remains within a sufficiently small operating distance of the first global positioning system receiver at the time of the step of locating and converting, that variations in systematic bias errors between the first global positioning system receiver and the second global positioning system receiver are negligible.

15. The method of claim 14, wherein the operating distance is less than about 100 miles.

* * * * *